United States Patent [19]

Passera, deceased et al.

[11] 3,993,034

[45] Nov. 23, 1976

[54] FUEL INJECTION SYSTEM

[75] Inventors: Walter Passera, deceased, late of Stuttgart, Germany, by Ludwig Passera, heir; Heinrich Knapp, Leonberg-Silberberg; Wolf Wessel, Schwieberdingen, both of Germany

[73] Assignee: Robert Bosch G.m.b.H., Stuttgart, Germany

[22] Filed: May 13, 1975

[21] Appl. No.: 577,118

[30] Foreign Application Priority Data

May 13, 1974 Germany ..... 2423109

[52] U.S. Cl. ..... 123/139 AW; 123/140 MC

[51] Int. Cl.[2] ..... F02M 69/00

[58] Field of Search ..... 123/139 AW, 140 MC, 123/119 R, 32 EA; 261/50 A

[56] References Cited

UNITED STATES PATENTS

| | | | |
|---|---|---|---|
| 3,791,359 | 2/1974 | Eckert et al. | 123/119 R |
| 3,835,828 | 9/1974 | Knapp | 23/119 R |
| 3,842,813 | 10/1974 | Eckert | 123/119 R |
| 3,900,014 | 8/1975 | Bundesen et al. | 123/119 R |

*Primary Examiner*—Charles J. Myhre
*Assistant Examiner*—Tony M. Argenbright
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, an uncoupling throttle disposed between a fuel supply conduit and the control pressure conduit, at least one electromagnetic valve disposed in the control pressure conduit for varying pressure in the control pressure conduit in dependence on at least one operating parameters of the engine, at least one pressure regulating valve also serving to vary the pressure in the control pressure conduit, and a storage element for hydraulic integration during pressure changes in the control pressure conduit. The storage element, the electromagnetic valve and the pressure regulating valve are disposed in series in the control pressure conduit downstream of the uncoupling throttle, and the restoring force is generated by the fuel pressure downstream of the uncoupling throttle.

1 Claim, 4 Drawing Figures

U a
t
I
t
P
t

FUEL INJECTION SYSTEM

BACKGROUND OF THE INVENTION

The present invention relates to a fuel injection system for an externally ignited internal combustion engine.

The system according to the present invention operates on fuel which is continuously injected into the suction tube of the engine in which an air sensing element and an arbitrarily operable throttle valve (butterfly valve) are disposed in series. The sensing element is displaced by and in proportion to the throughgoing quantity of air against a restoring force. In the course of its excursion the sensing element displaces a movable component of a valve which is disposed in the fuel supply line and which is intended for metering a quantity of fuel which is proportionate to the quantity of air. The aforenoted restoring force is supplied by liquid under pressure which is delivered continuously through a control pressure line which is separated from the fuel supply line by an uncoupling throttle and which exerts a force on a control plunger. The pressure of the pressurized liquid is variable by at least one electromagnetic valve controllable as a function of the operating parameters of the internal combustion engine and by at least one pressure regulating valve containing a temperature-dependent heatable control element.

Fuel injection systems of this type are designed to automatically provide an advantageous fuel-air mixture for all operational conditions of the internal combustion engine so as to burn the fuel as completely as possible and thus prevent toxic gases from being produced, or at least to considerably reduce the same while obtaining maximum performance of the internal combustion engine with minimum fuel consumption. The quantity of fuel must therefore be very accurately metered in accordance with the requirements of each operational state of the internal combustion engine and the air-fuel ratio must be varied as a function of the operating parameters such as speed, load, temperature and exhaust gas composition.

In the case of known fuel injection systems of this type, the quantity of fuel which is metered is, as far as possible, proportionate to the quantity of air flowing through the suction tube and this metered quantity of fuel may be varied by changing the restoring force of the sensing element as a function of the operating parameters by means of an electromagnetic valve.

OBJECTS AND SUMMARY OF THE INVENTION

An object of the present invention is to provide a fuel injection system of the known type by means of which the restoring force on the air sensing element may be varied by controlling the fluid pressure acting on a slide member of a fuel metering and distributing valve of the fuel injection system which pressure is in opposition to the displacements of an air sensing element of the fuel injection system.

Another object of the present invention is to provide a fuel injection system of the known type by means of which the restoring force on the air sensing element may be varied by simple means in dependence on the composition of the exhaust gas immediately upon termination of the warm-up phase of the internal combustion engine.

These and other objects are accomplished according to the present invention in that a storage element used for hydraulic integration during pressure variations, an electromagnetic valve and a pressure regulating valve are disposed in series in a control pressure line downstream of an uncoupling throttle, and in that force is exerted on a control plunger of a fuel metering and distributing valve by the fuel pressure downstream of the uncoupling throttle.

An advantageous feature of the present invention results from the arrangement in which a throttle is disposed downstream of the electromagnetic valve and another throttle is disposed parallel to the electromagnetic valve and the first throttle, and in which the electromagnetic valve is controllable as a function of the oxygen content in the exhaust gas by means of a so-called oxygen probe via an electronic amplifier.

According to another advantageous feature of the present invention, the oxygen probe may be short-circuited during the warm-up phase of the internal combustion engine by means of a switch and with the electromagnetic valve opened. The switch consists of a temperature-dependent heatable control element which is in the form of a bi-metallic spring and which is connected to ground during the warm-up phase of the internal combustion engine via a spring washer and a spring, which determines the control pressure of the pressure regulating valve.

Another advantageous feature of the present invention results from an arrangement in which a first and a second throttle are disposed parallel to the electromagnetic valve and in which the electromagnetic valve is open during the warm-up phase of the internal combustion engine and a second electromagnetic valve is disposed parallel to the uncoupling throttle, the storage element and the first throttle. The second electromagnetic valve is controllable as a function of the oxygen content in the exhaust gas of the engine by means of a so-called oxygen probe via an electronic amplifier and is closed during the warm-up phase.

Still another advantageous feature of the present invention results from an arrangement in which a first throttle and a second electromagnetic valve are disposed parallel to the storage element, electromagnetic valve and the pressure regulating valve and in which during the warm-up phase of the engine the electromagnetic valve is open and the second electromagnetic valve which is controlled by a so-called oxygen probe as a function of the oxygen content in the exhaust gas of the engine is closed.

Three embodiments of the invention are represented in simplified form in the drawings and these will be described in more detail hereinafter.

DESCRIPTION OF THE PREFERRED EMBODIMENTS

Figure 1:
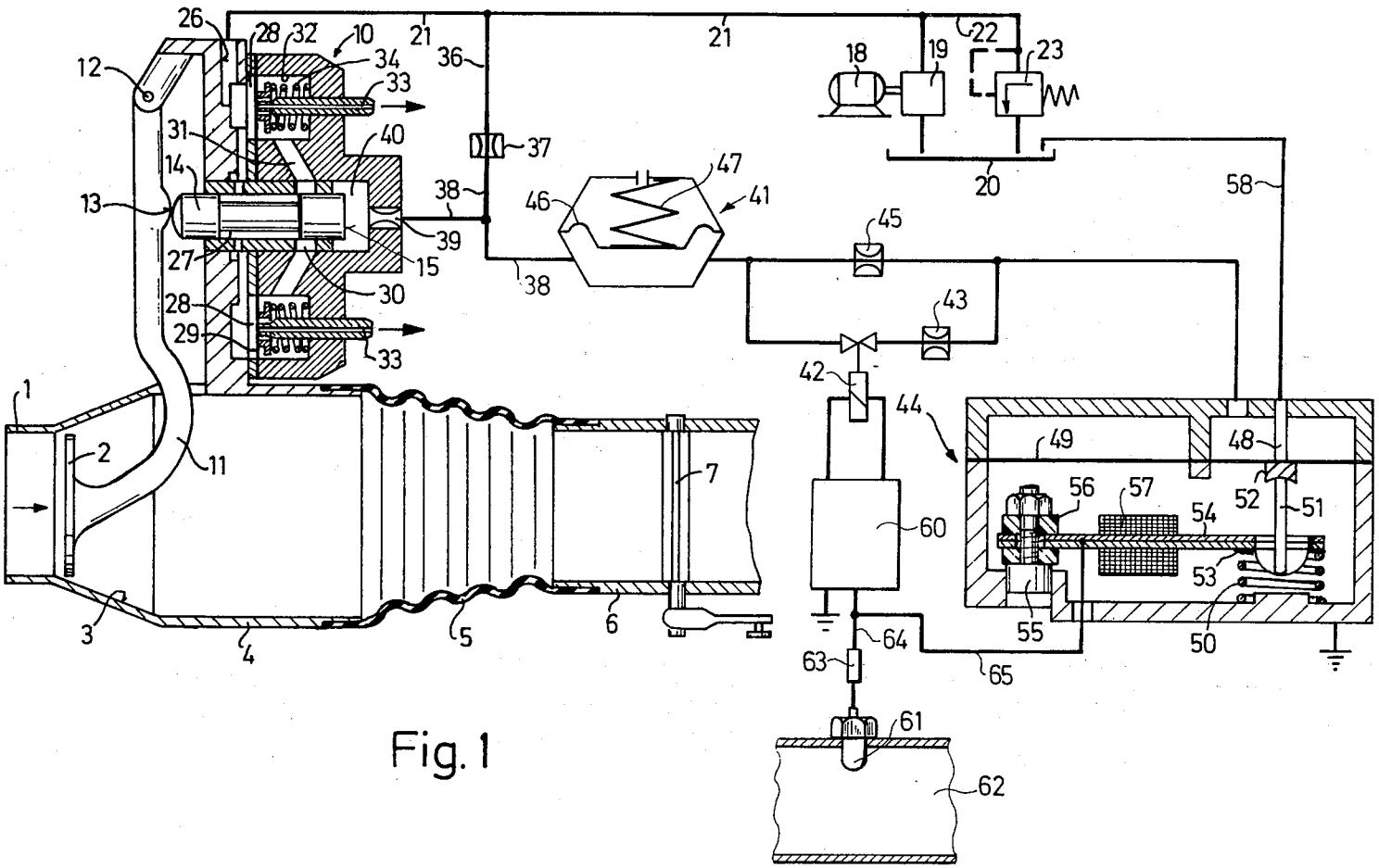
FIG. 1 illustrates a first embodiment of the fuel injection system according to the present invention.

In the embodiment of the fuel injection system shown in FIG. 1 the combustion air flows in the direction of the arrow through a suction tube portion 1 past an air sensing element or air sensor 2, which is disposed in a conical portion 3, through a suction tube portion 4 and thereafter through a coupling hose 5 into a suction tube portion 6 in which there is disposed an arbitrarily operable throttle valve (butterfly valve) 7. From the latter the combustion air flows to one or more cylinders (not shown) of an internal combustion engine. The air sensor 2 consists of a plate disposed at right angles to the direction of air flow and is displaced in the conical suction tube portion 3 as an approximately linear function of the air flowing through the suction tube. Given a constant restoring force exerted on the air sensor 2 as well as a constant pressure prevailing upstream of the air sensor 2, the pressure prevailing between the air sensor 2 and the throttle valve 7 also remains constant.

The air sensor 2 directly controls a fuel metering and distributing valve 10. For the transmission of the motion of the air sensor 2 there is provided a lever 11 which is connected to the air sensor at one end and pivotably mounted by a pivot pin 12 at the other end. The lever 11 is provided with a nose 13 and during the pivoting movement of the lever the nose 13 actuates a movable slide member 14 which forms part of the fuel metering and distributing valve 10. The slide member 14 serves as a control plunger, including a front face 15 which is remote from the nose 13. The front face 15 is exposed to the force of pressurized liquid. The pressure of the liquid acting on the face 15 produces the restoring force which is exerted on the air sensor 2.

Fuel is supplied by means of a fuel pump 19 which is driven by an electric motor 18 and which draws fuel from a fuel tank 20 and delivers it through a conduit 21 to the fuel metering and distributing valve 10. From the conduit 21 there extends a conduit 22 in which is disposed a pressure limiting valve 23. When there is excessive pressure in the system the pressure limiting valve allows fuel to flow back into the fuel tank 20.

From the fuel supply conduit 21 the fuel is admitted into a channel 26 provided in the housing of the fuel metering and distributing valve 10. The channel 26 leads to an annular groove 27 of the control plunger 14 and further leads through several branch conduits to chambers 28 on one side of a membrane 29 so that the one side of the membrane 29 is exposed to fuel pressure. Dependent upon the axial position of the control plunger 14, the annular groove 27 overlaps and as a result opens to a greater or lesser extent control slots 30 which lead through channels 31 to chambers 32. Each of the latter is separated from a corresponding chamber 28 by means of the membrane 29. From the channels 32 the fuel is admitted through injection channels 33 to the individual fuel injection valves (not shown) which are positioned in the suction tube in the vicinity of a corresponding engine cylinder. The membrane 29 serves as the movable part of a flat seat valve which, when the fuel injection system is inoperative, is maintained open by means of springs 34. The membrane boxes each formed of a chamber 28 and 32 ensure that, independently of the overlap between the annular groove 27 and the control slots 30, that is, independently of the quantity of fuel flowing to the fuel injection valves, the pressure drop at the fuel metering valves 27, 30 remains substantially constant. In this way, it is ensured that the extent of displacement of the control plunger 14 and the metered fuel quantity are proportionate to one another.

Upon a pivotal movement of the lever 11, the air sensor 2 is moved in the conical portion 3 of the suction tube and, as a result, the annular flow passage section between the air sensor 2 and the cone changes in proportion to the extent of the displacement of the air sensor 2.

The liquid producing the constant restoring force on the control plunger 14 is fuel. For this purpose, from the conduit 21 there extends a conduit 36 which is separated from a pressure control conduit 38 by means of an uncoupling throttle 37. A pressure chamber 40 communicates with the control pressure conduit 38 via a damping throttle 39. The front face 15 of the control plunger 14 projects into the pressure chamber 40.

A storage element 41, an electromagnetic valve 42, a throttle 43 and a pressure regulating valve 44 are disposed in series in the control pressure conduit 38 downstream of the uncoupling throttle 37. A further throttle 45 is disposed parallel to the electromagnetic valve 42 and the throttle 43. The storage element 41 may be in the form of a diaphragm (membrane) storage element comprising a flexible membrane 46 which acts against a spring 47.

The pressure of the pressurized liquid producing the restoring force can be varied in a temperature-dependent manner by means of the pressure regulating valve 44. The pressure regulating valve 44 is in the form of a flat seat valve having a stationary valve seat 48 and a membrane 49 which is bias loaded in the closing direction of the pressure regulating valve by a spring 50. The closing force of the spring 50 is transmitted by a pin 51 which is gripped via a bearing seat 52 and a spring rest 53 between the membrane 49 and the spring 50. At temperatures below the engine operating temperature the spring 50 acts against a bimetallic spring 54 via the spring rest 53. At its other end the bi-metallic spring 54 is bolted by means of a bolt 55 pressed into the housing of the pressure regulating valve 44. The bi-metallic spring is largely prevented from heat loss through the conduction of heat to the housing of the pressure control valve by means of an insulating element 56 disposed between the bolt 55 and the bi-metallic spring 54. An electric heater 57, energized in a conventional manner, is mounted on the bi-metallic spring 54. Downstream of the pressure regulating valve 44 the fuel is returned to the fuel tank 20 through the depressurized return flow line 58.

The electromagnetic valve 42 is controllable by means of a so-called oxygen probe 61 via an electronic amplifier 60 as a function of the oxygen content of the exhaust gas of the internal combustion engine. The oxygen probe 61 is disposed in the exhaust gas conduit 62 of the engine and is coupled via a resistance 63 and a line 64 to the electronic amplifier 60. During the warm-up phase of the internal combustion engine the oxygen probe 61 may be short-circuited via a line 65 which is connected to the bi-metallic spring 54 whereby the bi-metallic spring 54 is connected to ground via the spring washer 53 and the spring 50.

The fuel injection system operates as follows:

When the internal combustion engine is running, fuel is drawn from the tank 20 by the pump 19 driven by the electric motor 18 and forced through the conduit 21 to the fuel metering and distributing valve 10. At the same time, the internal combustion engine draws air through the suction tube 1 and, as a result, the air sensor 2 undergoes a certain excursion from its rest position. In response to the deflection of the air sensor 2, the control plunger 14 is displaced via the lever 11 and thus the fuel flow passage section at the control slots 30 is increased. The direct connection between the air sensor 2 and the control plunger 14 ensures a constant ratio between the quantity of air and the metered quantity of fuel provided the characteristics of these two components are sufficiently linear (which is desideratum by itself). In such a case, the fuel-air ratio would be constant for the entire operational range of the engine. However, it is necessary for the fuel-air mixture to be richer or leaner depending on the operational conditions and this is achieved by varying the restoring force acting on the air sensor 2. For this purpose there is provided in the control pressure conduit 38 and electromagnetic valve 42 and a pressure regulating valve 44 which, by influencing the pressure of the pressurized liquid during the warm-up phase of the internal combustion engine, influences the mixture enrichment in dependence on temperature until the operating temperature of the internal combustion engine is reached. The closing force of the spring 50 transmitted by the pin 51 to the membrane 49 determines the control pressure. However, at temperatures below the operating temperature of the internal combustion engine the bi-metallic spring 54 exerts a force on the spring rest 53 against the force of the spring 50, thereby reducing the closing force exerted on the membrane 49. However, immediately after the engine is started, the bi-metallic spring 54 is heated by means of the electric heater 57 which results in a reduction in the force transmitted by the bi-metallic spring 54 to the spring rest 53. The requisite initial biasing of the bi-metallic spring 54 can be achieved by pressing the bolt 55 into the housing of the pressure regulating valve 44 to varying depths.

Figure 2:
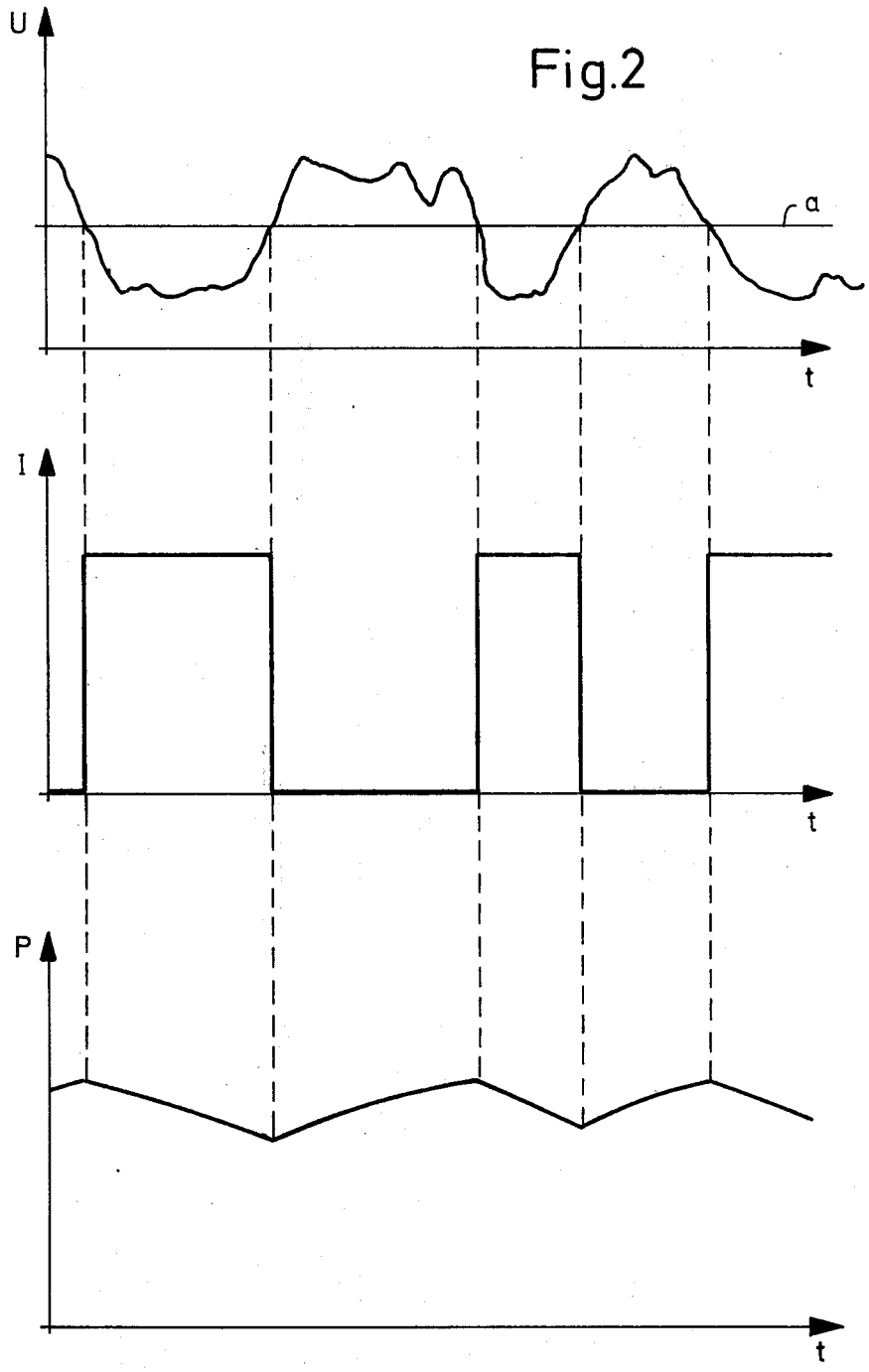
FIG. 2 illustrates the time slope of the oxygen probe voltage of the control current at the electromagnetic valve and the pressure in the control pressure line.

The oxygen probe 61 supplies a voltage U which is dependent on the oxygen content in the exhaust gas of the internal combustion engine. The variation of the voltage U over the period *t* is represented by way of example in FIG. 2. The line *a* represents a threshold value above which the electronic amplifier 60 ceases to supply a control current I and thus the electromagnetic valve 42 is closed. In this operating state only the further throttle 45 is effective and thus a relatively high control pressure prevails in the pressure chamber 40. This relatively high control pressure is synonymous with a relatively powerful restoring force acting on the air sensor 2. This operating state is characterized by a rich fuel-air mixture. If the probe voltage U now drops below the threshold value a, the electronic amplifier 60 supplies a control current I and the electromagnetic valve 42 opens. As the throttle 43 now becomes active in addition to the further throttle 45, the control pressure in the pressure chamber 40 is reduced and accordingly also the restoring force on the air sensor 2. This operating state is characterized by a lean fuel-air mixture. The storage element 41 prevents pressure changes from proceeding in a jerky manner. FIG. 2 also shows the variation of the control pressure *p* in the control pressure conduit 38.

As a rich fuel-air mixture is essentially desirable during the warm-up phase of the internal combustion engine it is necessary to prevent regulation by the oxygen probe during this phase. For this reason the oxygen probe is short-circuited during the warm-up phase of the internal combustion engine. This is made possible by connecting the oxygen probe to ground via the line 65 which is connected to the bi-metallic spring 54. Immediately upon termination of the warm-up phase the bi-metallic spring 54 is removed from the spring rest 53, thereby interrupting the short-circuit line. The electromagnetic valve 42 is open during the warm-up phase of the internal combustion engine.

Figure 3:
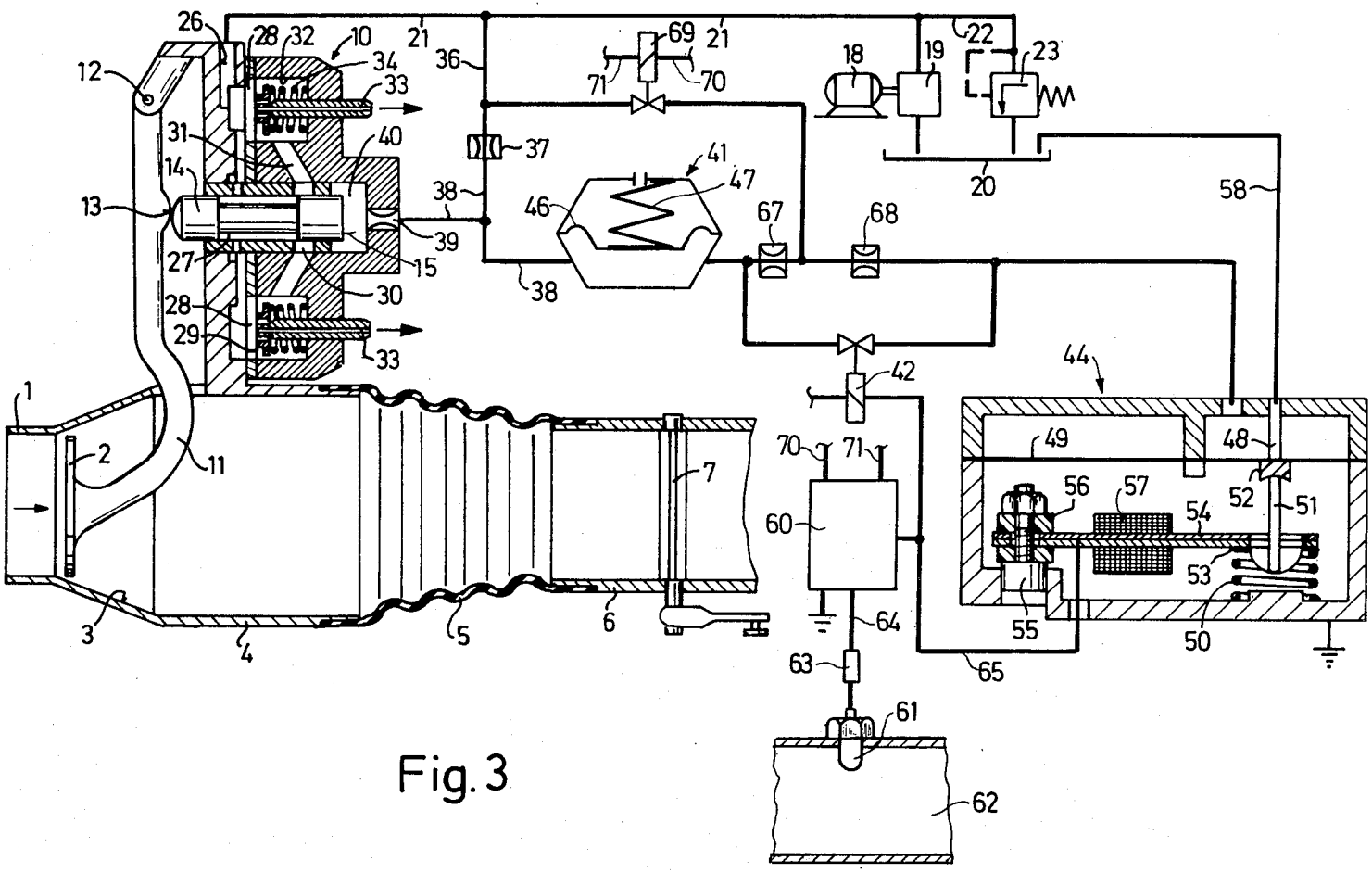
FIG. 3 illustrates a second embodiment of the fuel injection system according to the present invention.

FIG. 3 shows a second embodiment of the fuel injection system according to the present invention. The identical parts to those represented in FIG. 1 are designated by the same reference numbers. In the embodiment shown in FIG. 3 a first throttle 67 and a second throttle 68 are connected in parallel with the electromagnetic valve 42. By eliminating the throttle 43 which is connected in series with the electromagnetic valve 42 as shown in the embodiment according to FIG. 1, a higher pressure level can be provided at the pressure regulating valve 44, thereby increasing the accuracy of the pressure regulating valve during the warm-up phase. The electromagnetic valve 42 is only open during the warm-up phase.

The second embodiment according to FIG. 3 also contains a second electromagnetic valve 69 which is disposed parallel to the uncoupling throttle 37, the storage element 41 and the first throttle 67. The second electromagnetic valve 69 is connected to the electronic amplifier 60 via electric lines 70 and 71 and is controlled by the oxygen probe 61 in such a way that it is open when there is a rich fuel-air mixture and closed when there is a lean fuel-air mixture. By short-circuiting the oxygen probe 61 the second electromagnetic valve 69 also remains closed during the warm-up phase of the internal combustion engine. An advantage of the disposition of the second electromagnetic valve 69 according to the second embodiment is that the entire pressure in the system can be brought to bear on the control plunger 14.

Figure 4:
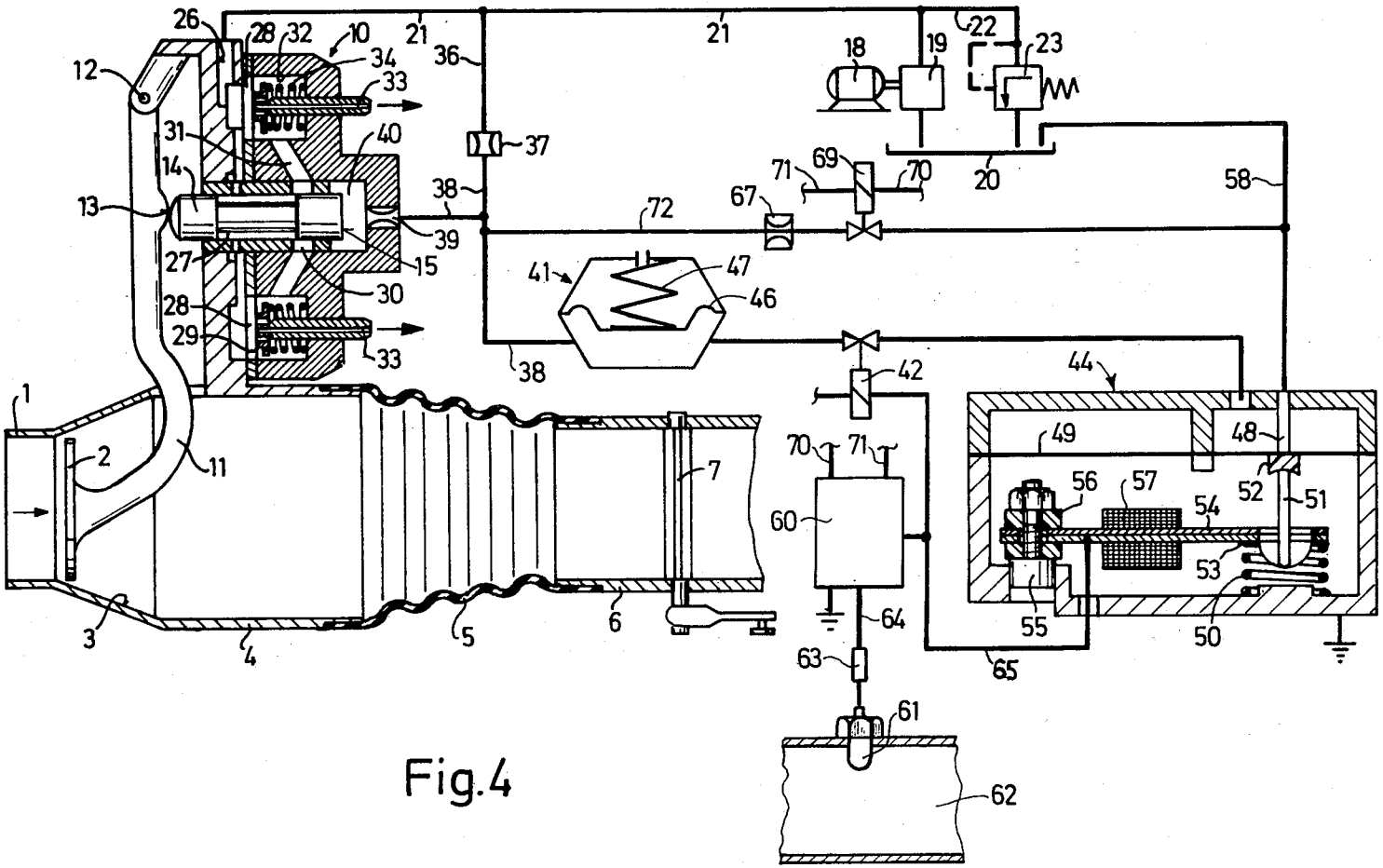
FIG. 4 illustrates a third embodiment of the fuel injection system according to the present invention.

In contrast to the second embodiment, in the third embodiment according to the present invention shown in FIG. 4 the first throttle 67 and the second electromagnetic valve 69 are disposed in a line 72 parallel to the storage element 41, the electromagnetic valve 42 and the pressure regulating valve 44. This embodiment not only has the advantage of raising the pressure level at the pressure regulating valve 44 during the warm-up phase as in the case of the second embodiment, but it also has the advantage that a greater pressure drop is available for control pressure regulation by the second electromagnetic valve 69 than in the case of the preceding embodiments.

What is claimed is:

1. A fuel injection system for externally ignited internal combustion engines comprising in combination:

a. a suction tube for air intake to the engine;
b. an air sensor disposed in said suction tube;
c. an arbitrarily operable butterfly valve disposed in said suction tube in series with said air sensor;
d. a fuel supply conduit;
e. a control pressure conduit;
f. an uncoupling throttle disposed between said fuel supply conduit and said control pressure conduit;
g. a fuel metering valve connected to said fuel supply conduit and said control pressure conduit for continuously injecting fuel into said suction tube;
h. a control plunger, serving as the movable member of said fuel metering valve, said control plunger being acted upon on one end by said air sensor, and on an opposite end by a return force provided by liquid under pressure delivered by said control pressure conduit, for metering a fuel quantity that is proportionate to the quantity of air measured by said air sensor;

i. at least one electromagnetic valve disposed in said control pressure conduit for varying pressure in said control pressure conduit in dependence on at least one operating parameter of the engine;

j. at least one pressure regulating valve having a temperature-dependent heatable control element mounted therein, said regulating valve also serving to vary the pressure in said control pressure conduit;

k. a storage element for hydraulic integration during pressure changes in the control pressure conduit;

l. an oxygen probe for detecting the oxygen content of the exhaust gas of the internal combustion engine;

m. an electronic amplifier connected to the oxygen probe;

n. a first throttle; and o. a second electromagnetic valve disposed parallel to the storage element, the electromagnetic valve and the pressure regulating valve, wherein:

i. the storage element, the electromagnetic valve and the pressure regulating valve are disposed in series in the control pressure conduit downstream of the uncoupling throttle;

ii. the restoring force exerted against the control plunger is generated by the fuel pressure downstream of the uncoupling throttle;

iii. the second electromagnetic valve is controlled by the oxygen probe via the electronic amplifier as a function of the oxygen content of the exhaust gas of the internal combination engine; and iv. during the warm-up phase of the internal combustion engine the electromagnetic valve is open and the second electromagnetic valve is closed.

* * * * *